US005248352A

United States Patent [19]

Nakahara et al.

[11] Patent Number: 5,248,352

[45] Date of Patent: Sep. 28, 1993

[54] TIC-BASE CERMET ALLOY

[75] Inventors: Yuichi Nakahara, Kumagaya; Katsuhiko Kojo, Fukaya, both of Japan

[73] Assignees: Hitachi Metals, Ltd.; Hitachi Tool Engineering, Ltd., Tokyo, Japan

[21] Appl. No.: 858,000

[22] Filed: Mar. 26, 1992

[30] Foreign Application Priority Data

Mar. 27, 1991 [JP] Japan ..... 3-087550
Feb. 6, 1992 [JP] Japan ..... 4-056462

[51] Int. Cl.[5] ..... C22C 14/00

[52] U.S. Cl. ..... 148/421; 75/236; 75/237

[58] Field of Search ..... 148/421; 75/236, 237

[56] References Cited

U.S. PATENT DOCUMENTS 4,574,011 3/1986 Bonjour et al. ..... 75/236
4,650,353 3/1987 Rymas ..... 75/236
4,973,356 11/1990 Von Holst et al. ..... 75/236
5,068,003 11/1991 Takahashi et al. ..... 148/421
5,145,505 9/1992 Saito et al. ..... 75/236

FOREIGN PATENT DOCUMENTS 2711509 9/1978 Fed. Rep. of Germany .
63-83241 4/1988 Japan .
2-93036 4/1990 Japan .
2-145741 6/1990 Japan .
1037568 7/1966 United Kingdom .
1192726 5/1970 United Kingdom .
1204802 9/1970 United Kingdom .

*Primary Examiner*—Upendra Roy
*Attorney, Agent, or Firm*—Finnegan, Henderson, Farabow, Garrett & Dunner

[57] ABSTRACT

There can be provided a TiC-base cermet alloy whose hardness is equal to or higher than that of a Ti(C, N)-base cermet alloy and which is excellent in toughness by strengthening the binder phase of the TiC-Base cermet alloy which does not involve the problem of denifrification at the time of sintering. The titanium-carbide-base cermet alloy comprises a hard phase which contains titanium carbide as a main component and a binder phase which contains one or both of Co and Ni as main components, wherein amounts of Ti and Mo in the binder phase satisfy the conditions, by weight T: 0.85≦Mo (wt. %)/Ti (wt. %), and 6 wt. %≦[Ti +Mo].

2 Claims, 12 Drawing Sheets

TIC-BASE CERMET ALLOY

BACKGROUND OF THE INVENTION

The present invention relates to a cermet alloy of titanium-carbide (hereinafter referred to as TiC) base and, more particularly, to a TiC-base cermet alloy which is increased in both strength and toughness by strengthening its binder phase.

Currently, an alloy of titanium-nitride (hereinafter referred to as Ti(C, N)) base containing nitrogen is mainly used as a cermet alloy for machining tools. Ti(C, N)-base cermet alloy is improved in room-temperature strength, oxidation resistance and machinability in comparison with a conventional TiC-base cermet alloy.

In both of the TiC-base cermet alloy and the Ti(C, N)-base cermet alloy, the hard phase is constituted of particles of a core structure which comprises a core portion (TiC, Ti(C, N), respectively) and a peripheral portion ((Ti, Mo)C, (Ti, Mo)(C, N), respectively) surrounding the core portion. Particles of the Ti(C, N)-base cermet alloy are refined due to containing nitrogen, and thus, its room-temperature strength is improved.

Also, it is publicly known that the Ti(C, N)-base cermet alloy is excellent in high-temperature strength High-temperature strength of a TiC-$Mo_2C$-Ni alloy containing nitrogen is explained in detail in "Fine Particles and Powder Metallurgy", Vol. 30, No. 3, April, 1983, saying that this alloy has an excellent high-temperature strength because a larger amount of Mo is dissolved in the binder phase so as to suppress dynamic recovery of the binder phase. Although the process of soluting of Mo into the binder phase is not mentioned in the above document, it can be presumed as follows: titanium, which is over saturated as a result of denitrification of Ti(C, N) at the time of vacuum sintering, is combined with carbon of $Mo_2C$ to form a carbide, and the remainder molybdenum is dissolved into the binder phase.

This document also discloses that the large the nitrogen content is, the more molybdenum will be dissolved in the binder phase, and that the larger the amount of addition of $Mo_2C$, which is supplying source of Mo, is, the more molybdenum will be dissolved. For instance, in an alloy whose composition by wt. % is $TiC_{0.7}N_{0.3}$-11%$Mo_2C$-24%Ni, the amount of Mo in the binder phase is 3.4 wt. % (the amount of dissolved Ti is 10.6 wt. %), in an alloy whose composition by wt. % is $TiC_{0.7}N_{0.3}$-19%$Mo_2C$-24%Ni, the amount of Mo is 10.0 wt. % (the amount of dissolved Ti is 9.3 wt. %), and in an alloy whose composition by wt. % is $TiC_{0.7}N_{0.3}$-27%$Mo_2C$-24%Ni, the amount of Mo is 8.2 wt. % (the amount of dissolved Ti is 5.7 wt %). On the other hand, in an alloy whose composition by wt. % is TiC-11%$Mo_2C$-24% Ni-containing no nitrogen, the amount of Mo is 0.2 wt. % (the amount of dissolved titanium is 12.7 wt. %), and in an alloy whose composition by wt. % is TiC-19%$Mo_2C$-24%Ni containing no nitrogen, the amount of Mo is 1.8 wt. % (the amount of dissolved titanium is 16.3 wt. %). It can be understood from this result that, in the case of the TiC-base cermet alloy containing no nitrogen, it will be extremely difficult to strengthen the binder phase even if the amount of addition of $Mo_2C$ is increased.

As described above, the Ti(C, N)-base cermet alloy has better properties in comparison with the TiC-base cermet alloy. However, it involves some problems, for example, changes are caused between the properties of the surface and the inner portion of the cermet alloy and pores are likely to be formed in the structure when the cermet alloy is denitrified at the time of vacuum sintering. If pores are formed in the structure, it is impossible to obtain the strength which the Ti(C, N)-base cermet alloy is originally supposed to have.

With relation to this problem, there have been made various proposals such as introduction of nitrogen gas in the sintering environment, and control of temperature elevating conditions (e.g., JP-A-2-93036, 2-145741 and so forth). However, these suggestions are not favorable in respect of the productivity.

Moreover, as compared with the TiC-base cermet alloy, the Ti(C, N)-base cermet alloy has higher hardness but is inferior in toughness. In relation to this problem, there have also been made various proposals for solving it. The inventors of the present application proposed a method of adding WC independently and separately from a solid solution with Ti(C, N) in JP-A-63-83241. However, essential improvement has not been accomplished in by JP-A-63-83241.

SUMMARY OF THE INVENTION

In the light of the above problems, according to the present invention, there is provided a TiC-base cermet alloy whose hardness is equal to or higher than that of the Ti(C, N)-base cermet alloy and which is especially excellent in toughness by strengthening the binder phase of the TiC-base cermet alloy which does not involve the problem of denitrification at the time of sintering.

The invention alloys are provided in the following forms:

a) A titanium-carbide-base cermet alloy comprising a hard phase which contains titanium carbide as a main component and a binder phase which contains one or both of Co and Ni as main components, wherein amounts of Ti and Mo in the binder phase satisfy the conditions, by weight %: $0.85 \leqq$ Mo (wt. %)/Ti(wt. %), and 6 wt. % $\leqq$ [Ti + Mo].

b) A titanium-carbide-base cermet alloy comprising a hard phase which contains titanium carbide and tungsten carbide as main components and a binder phase which contains one or both of Co and Ni as main components, wherein amounts of Ti and Mo in the binder phase satisfy the conditions, by weight %: $0.85 \leqq$ Mo (wt. %)/Ti (wt. %), and 7 wt. % $\leqq$ [Ti + Mo + W].

In the invention, the amounts of Ti and Mo in the binder phase must satisfy the conditions of 6 wt. % $\leqq$ [Ti + Mo] because it is the minimum limit required for strengthening the binder phase. The amounts of Ti and Mo in this case are expressed by weight % in the binder phase which can be obtained by ICP (inductively coupled plasma) emission spectral analysis, which will be described later in the Example.

In order to obtain both excellent toughness and hardness, it is necessary not only to arrange the amounts of Ti and Mo in the binder phase within the above range but also to arrange the ratio of the amounts of Mo and Ti to satisfy the condition of $0.85 \leqq$ Mo (wt. %)/Ti (wt. %). This is probably because a large amount of Ti is dissolved in the binder phase when the ratio is less than 0.85, so that $Ni_3Ti$ which has low toughness precipitates to thereby deteriorate the toughness of the binder phase.

Although the hard phase of the cermet alloy according to the invention contains TiC as a main component, it may contain other carbides Especially, tungsten carbide (hereinafter referred to as WC) is a substance which is also effective for improving the sintering properties. The amount of addition of WC in this case should preferably be in the range of 5 vol.% ≦ WC ≦ 50 vol.%. If it is below 5 vol.%, a sufficient effect of improving sintering properties can not be obtained, and if it exceeds 50 vol.%, adhesion of chips can not be ignored when the cermet alloy is used in the form of a cutting tool.

The binder phase contains one o both of Co and Ni as main components, and it also contains molybdenum serving as an element for strengthening it and titanium which is a component element of the hard phase. In the case where WC is employed for the hard phase, the binder phase will contain tungsten.

If the amount of one or both of Co and Ni is too high, the amount of the binder phase becomes lower and the amount of the hard phase relatively decreases, thereby degrading the hardness. Consequently, the amount of addition of one or both of Co and Ni should preferably be 15 vol.% or less, and more preferably, 10 vol.%.

DETAILED DESCRIPTION OF THE INVENTION

Figure 1A:
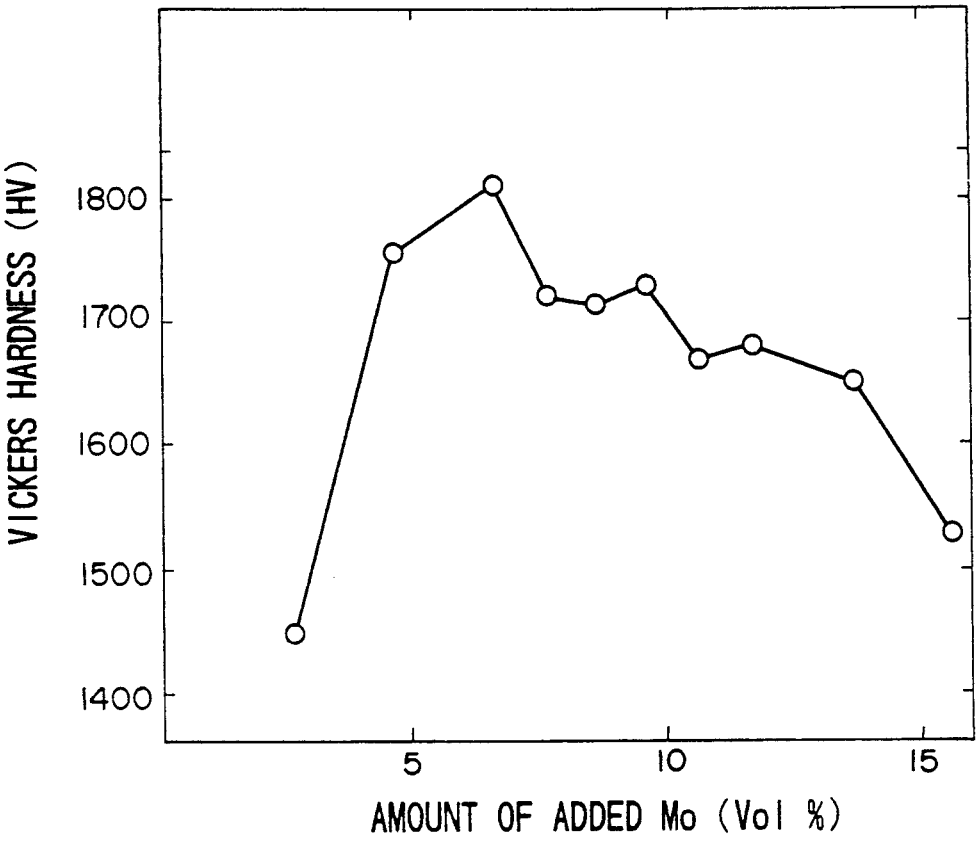
FIG. 1A is a graph illustrating relationship of the amount of addition of Mo with respect to the hardness in Example 1.

From the above description of the prior art, a person skilled in the art may easily expect that the binder phase can be strengthened by increasing the dissolved molybdenum content. As described before, however, the TiC-base cermet alloy is different from the Ti(C, N)-base cermet alloy in that the molybdenum amount in the binder phase can not be increased even if the amount of addition of $Mo_2C$ is increased.

A TiC-base cermet alloy whose binder phase has a relatively large amount of Mo dissolved therein is disclosed in "Cemented Carbide and Sintered Hard Material: Introduction and Application", by Hitoshi Suzuki, February, 1986, Maruzen, pp. 316–332.

For example, in an alloy whose composition by wt. % is TiC-10%Mo-30%Ni, Ti is about 11 wt. %, and Mo is about 2 wt. %, and in an alloy whose composition by wt. % is TiC-20%Mo-30%Ni, Ti is about 10 wt. %, and Mo is about 6 wt. %. It can be understood that when Mo is added in a metallic form, the Mo amount in the binder phase can be made, larger than when Mo is added in the form of a carbide ($Mo_2C$).

Thus, with regard to the TiC-base cermet alloy, the inventors of the present application conducted specific investigations about supplying Mo to be dissolved in the binder phase not as a carbide ($Mo_2C$) but in a metallic form.

The molybdenum amount in the binder phase became larger indeed by increasing the amount of addition of Mo in a metallic form. But the molybdenum amount in the binder phase was not merely increased, and when it was in a certain ratio to the Ti amount, strengthening of the binder phase could be also achieved. It was consequently found that the TiC-base cermet alloy can be remarkably improved in toughness in this manner while having the same level of hardness as the Ti(C, N)-base cermet alloy.

The present invention has been attained on the basis of the above knowledge, and it provides a TiC-base cermet alloy comprising a hard phase which contains TiC as a main component, and a binder phase, which is characterized in that the Ti and Mo contents in the binder phase satisfy the conditions 6 wt. ≦ [Ti+Mo] and 0.85 ≦ Mo (wt. %)/Ti (wt. %).

The structure of the cermet alloy according to the invention comprises a hard phase and a binder phase, and the hard phase has a so-called core structure. In the case where the cermet alloy contains TiC and WC as the hard phase, the hard phase has the core structure constituted of a central portion which is relatively rich in Ti and poor in W and a peripheral portion which is relatively rich in (W, Mo) and poor in Ti. The molybdenum content in the peripheral portion is a result of addition of molybdenum for the purpose of strengthening the binder phase.

Next, a method of manufacturing the cermet alloy of the invention will be explained.

The manufacturing method of the cermet alloy of the invention is characterized in that Mo serving as an element for strengthening the binder phase is added not as a carbide ($Mo_2C$) but in a metallic form. As described before, the reason is that a larger amount of Mo can be dissolved in the binder phase when molybdenum is added in a metallic form than as a carbide.

Moreover, when molybdenum is added in a metallic form, (Ti, W, Mo)C which is carbide constituting the peripheral portion can be refined so that the toughness can be expected to improve.

Furthermore, addition of Mo in a metallic form takes effects in reducing contact between carbide particles one another (hereinafter referred to as "skeleton"), thereby improving the toughness. More specifically, since the surface area of the skeleton in an ordinary TiC-base cermet alloy is about two to three times larger than that in a WC-base cemented carbide, the crack extending resistance is decreased, thus deteriorating the toughness. Especially when molybdenum is added in the form of $Mo_2C$, molybdenum is highly likely to remain as a carbide in the peripheral portion, so that the amount of molybdenum dissolved in the binder phase will be reduced. However, if molybdenum is added in a metallic form, the amount of Mo residing in the peripheral portion will be smaller than when molybdenum is added as a carbide, and the amount of Mo dissolved in the binder phase will be increased, to thereby reduce the skeleton.

Molybdenum can be added in a metallic form no only in the form of elemental molybdenum but also in the form of an alloy with Co or Ni which is a component element of the binder phase Besides, all of molybdenum need not be added in a metallic form. While molybdenum is mainly added in a metallic form, a certain amount of the carbide ($Mo_2C$) may be added without deviating from the spirit of the invention.

The present invention will now be described in detail on the basis of embodiments.

EXPERIMENT

Example 1

Powders of TiC, WC, Mo, Co and Ni corresponding to compositions shown in Table 1 were prepared. The grain sizes of the powders were as follows: in terms of average diameter, TiC: 1.5 μm, WC: 1.5 μm, Co: 2.0 μm, Ni: 2:5 μm, and Mo: 3.0 μm.

These material powders were put into denatured alcohol and mixed by an attriter for four hours.

As for the proportion of mixing for making the cermet alloy, TiC and WC, which are components of the hard phase, were arranged to amount to 60 to 90 wt. % of the whole, and Co, Ni and Mo in a metallic form, which are components of the binder phase, were arranged to amount to 10 to 40 wt. % of the whole.

The above mixtures, to each of which about 4 wt. % plasticizer (paraffin) serving as a molding assistant was added, were dried, sifted, molded into shapes of SNP432 (SNGN120408), and sintered in vacuum at 1500° to 1550° C. for one hour.

With these samples, Vickers hardness, cracking resistance (kg/mm) which expresses the toughness, and amounts (wt. %) of elements dissolved in the binder phase (maximum solubility of the elements in the binder phase was set as 100 %) were obtained.

Figure 5:
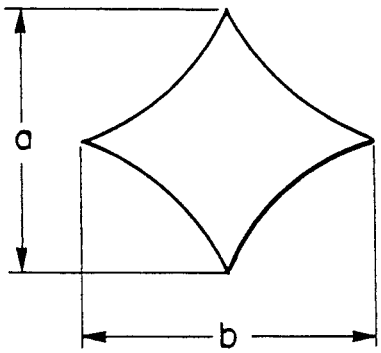
FIG. 5 shows a measuring method of Vickers hardness.

The Vickers hardness was obtained according to the JIS (JP Standard) by exerting a load of 30 kg on each sample by means of a diamond indenter, measuring distances a and b, as shown in FIG. 5, and consulting the known hardness conversion chart.

Figure 6:
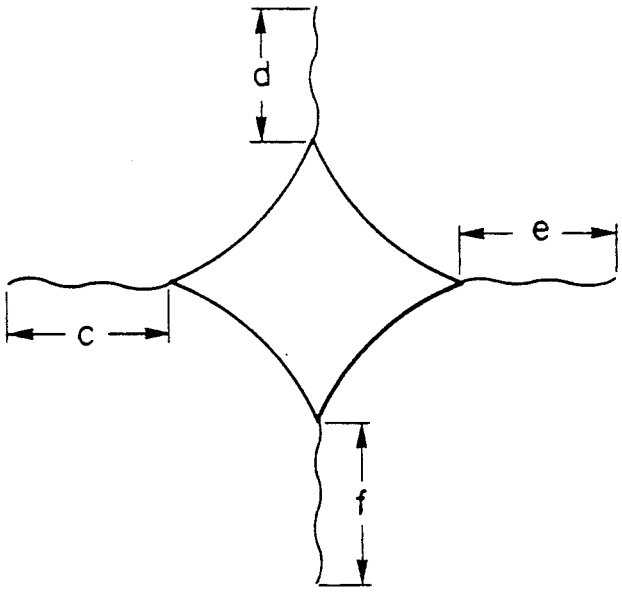
FIG. 6 shows a measuring method of cracking resistance.

The cracking resistance (kg/mm) was obtained, similarly to the Vickers hardness, by exerting a load of 50 kg on each sample by means of a diamond indenter, measuring distances c, d, e and f, as shown in FIG. 6, and calculating with the equation of load/(c+d+e +f).

Amounts of elements dissolved in the binder phase were obtained by dissolving the binder phase in mixed acid solution, extracting the elements, subjecting them to ICP (inductively coupled plasma) emission spectral analysis, so as to measure each of the elements in the binder phase.

Table 2 shows Vickers hardnesses, cracking resistances (kg/mm) and amounts of elements dissolved in the binder phase (wt. %). In Tables 1 and 2, symbols ○ indicate invention alloys, and symbols Δ indicate comparative alloys.

Any of the invention alloys has a hardness of Hv 1600 or more and a cracking resistance of 70 (kg/mm) or more, and is superior to conventional alloys (Sample Nos. 11 and 12) in these properties.

TABLE 1

| SAMPLE No. | COMPOSITION UPPER FIGURES: wt. % LOWER FIGURES: vol. % | | | | | |
|---|---|---|---|---|---|---|
| | TiC | WC | Mo | $Mo_2C$ | Co | Ni |
| Δ 1 | 37.4 | 52.0 | 3.3 | — | 2.6 | 4.7 |
| | 63.1 | 27.4 | 2.7 | — | 2.4 | 4.4 |
| Δ 2 | 37.9 | 48.9 | 5.9 | — | 2.6 | 4.7 |
| | 63.1 | 25.4 | 4.7 | — | 2.4 | 4.4 |
| ○ 3 | 38.4 | 45.6 | 8.5 | — | 2.6 | 4.9 |
| | 63.1 | 23.4 | 6.7 | — | 2.4 | 4.4 |
| ○ 4 | 38.7 | 44.0 | 9.8 | — | 2.6 | 4.9 |
| | 63.1 | 22.4 | 7.7 | — | 2.4 | 4.4 |
| ○ 5 | 38.9 | 42.3 | 11.2 | — | 2.7 | 4.9 |
| | 63.1 | 21.4 | 8.7 | — | 2.4 | 4.4 |
| ○ 6 | 39.2 | 40.6 | 12.5 | — | 2.7 | 5.0 |
| | 63.1 | 20.4 | 9.7 | — | 2.4 | 4.4 |
| ○ 7 | 39.5 | 38.9 | 13.9 | — | 2.7 | 5.0 |
| | 63.1 | 19.4 | 10.7 | — | 2.4 | 4.4 |
| ○ 8 | 39.8 | 37.2 | 15.3 | — | 2.7 | 5.0 |
| | 63.1 | 18.4 | 11.7 | — | 2.4 | 4.4 |
| ○ 9 | 40.4 | 33.5 | 18.2 | — | 2.8 | 5.1 |
| | 63.1 | 26.4 | 13.7 | — | 2.4 | 4.4 |
| Δ 10 | 40.9 | 29.9 | 21.2 | — | 2.8 | 5.1 |
| | 63.1 | 14.4 | 15.7 | — | 2.4 | 4.4 |
| CONVENTIONAL ALLOY 11 | 64TiCN—7WC-8NbC—0.5$Mo_2C$—6.5Co—3Ni | | | | | |
| CONVENTIONAL ALLOY 12 | 73.2TiCN—7.0WC—3.8$Mo_2C$—4.2TaC—7.4Co—3.9Ni | | | | | |

○: Invention Alloy, Δ: Comparative Alloy

TABLE 2

| SAMPLE No. | | BINDER PHASE ANALYSIS OF CERMET ALLOY (wt. %) Ti | W | Mo | Co | Ni | TOTAL AMOUNT OF BINDER PHASE (wt. %) | HARDNESS (Hv) | CRAKING RESISTANCE (kg/mm) |
|---|---|---|---|---|---|---|---|---|---|
| Δ 1 | | 2.8 | 0.1 | 0.5 | 40.7 | 55.9 | 5.9 | 1450 | 75 |
| Δ 2 | | 3.4 | 0.7 | 2.0 | 39.2 | 54.6 | 5.6 | 1760 | 65 |
| ○ 3 | | 3.3 | 1.1 | 4.2 | 35.1 | 56.3 | 5.5 | 1810 | 75 |
| ○ 4 | | 3.8 | 0.9 | 4.9 | 35.0 | 55.5 | 6.3 | 1720 | 79 |
| ○ 5 | | 4.9 | 1.1 | 6.4 | 33.2 | 54.5 | 5.9 | 1710 | 84 |
| ○ 6 | | 6.5 | 1.2 | 7.5 | 32.8 | 51.9 | 4.5 | 1730 | 91 |
| ○ 7 | | 8.7 | 1.1 | 10.1 | 31.3 | 48.9 | 3.5 | 1670 | 92 |
| ○ 8 | | 14.0 | 1.3 | 12.5 | 29.4 | 42.8 | 2.1 | 1680 | 78 |
| ○ 9 | | 12.7 | 1.0 | 11.6 | 27.5 | 47.1 | 2.6 | 1640 | 75 |
| Δ 10 | | 13.9 | 1.0 | 10.4 | 23.5 | 51.1 | 5.0 | 1530 | 58 |
| CONVENTIONAL ALLOY | 11 | 2.9 | 0.9 | 1.3 | 65.2 | 29.7 | 5.6 | 1740 | 45 |
| | 12 | 2.3 | 1.5 | 6.3 | 60.5 | 29.4 | 7.2 | 1525 | 75 |

○: Invention Alloy. Δ: Comparative Alloy

Figure 1B:
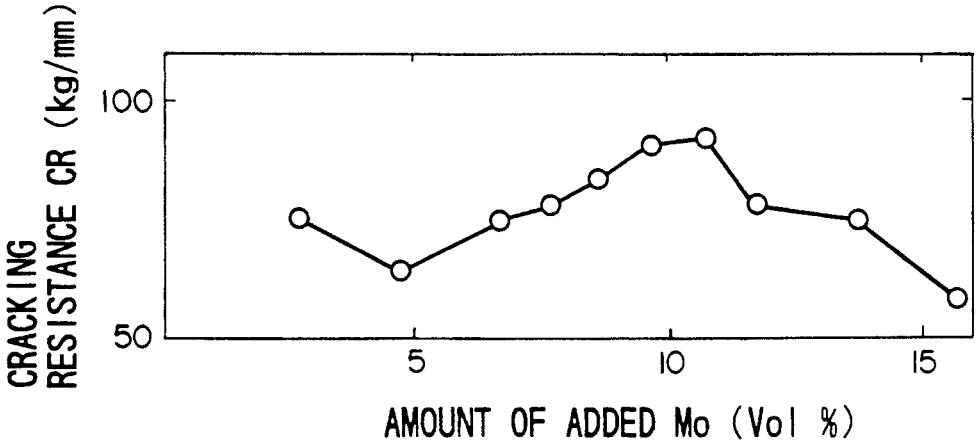
FIG. 1B is a graph illustrating relationship of the amount of addition of Mo with respect to the cracking resistance in Example 1.

FIGS. 1A and 1B illustrate relationships of the amount of addition of Mo with respect to the hardness and the cracking resistance shown in Table 2. It is obvious from FIGS. 1A and 1B that when the molybdenum amount is not less than 5 vol.% and not more than 15 vol.%, the hardness of Hv 1600 or more and the cracking resistance of 70 (kg/mm) or more can be obtained.

Further, it should be noted that the cracking resistance increases as the hardness increases in FIGS. 1A and 1B. This is surprising because it is known to those skilled in the art that hardness and cracking resistance are properties opposite to each other, and that the cracking resistance generally decreases as the hardness increases.

Figure 2A:
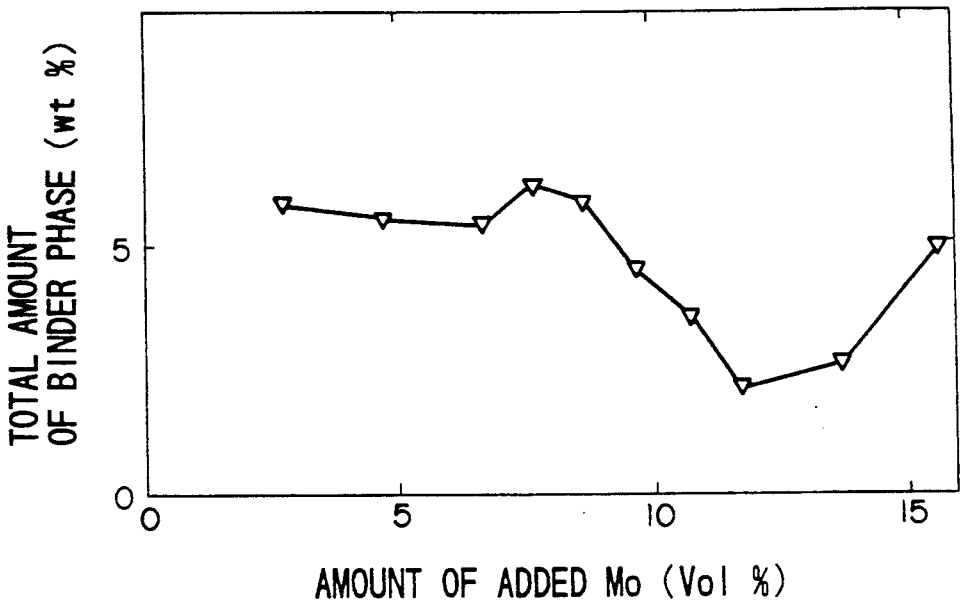
FIG. 2A is a graph illustrating relationship of the amount of the amount of addition of Mo with respect to the total amount of the binder phase in Example 1.
Figure 2B:
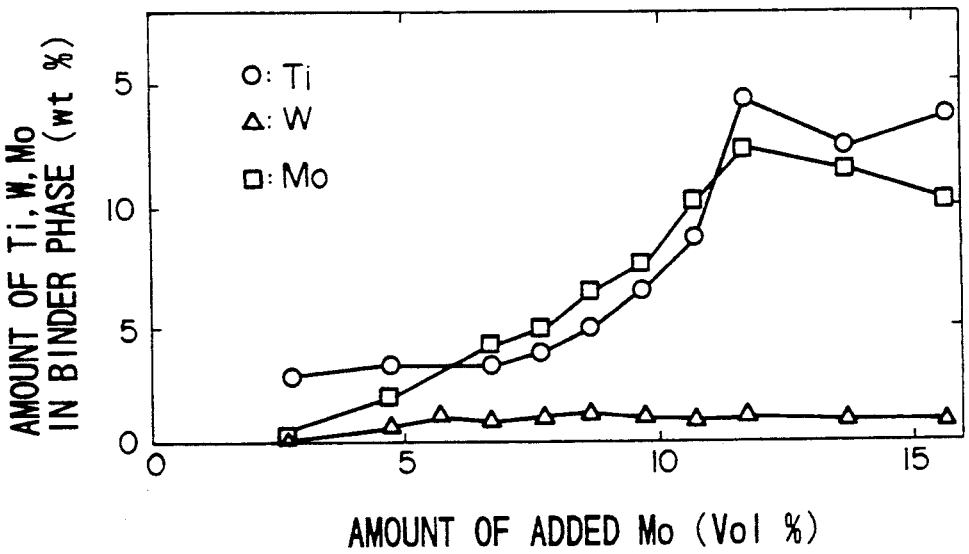
FIG. 2B is a graph illustrating relationship of the amount of the amount of addition of Mo with respect to amounts of Ti, Mo, W dissolved in the binder phase in Example 1.

FIGS. 2A and 2B illustrate relationships of the amount of addition of Mo with respect to the total amount of the binder phase (wt. %) and amounts of "Ti, Mo, W" soluted in the binder phase shown in Table 2. It is obvious from this graph that, as the amount of addition of Mo increases in a range of 7.7 to 11.7 vol.% (9.8 to 15.3 wt. %), the total amount of the binder phase tends to decrease whereas the amounts of dissolved "Ti and Mo" tend to increase on the contrary Besides, although more Mo is dissolved in the binder phase than Ti in this range, more Ti is dissolved in the binder phase than Mo in the other range. The amount of dissolved tungsten maintains substantially fixed values irrespective of the amount of addition of Mo.

Figure 3:
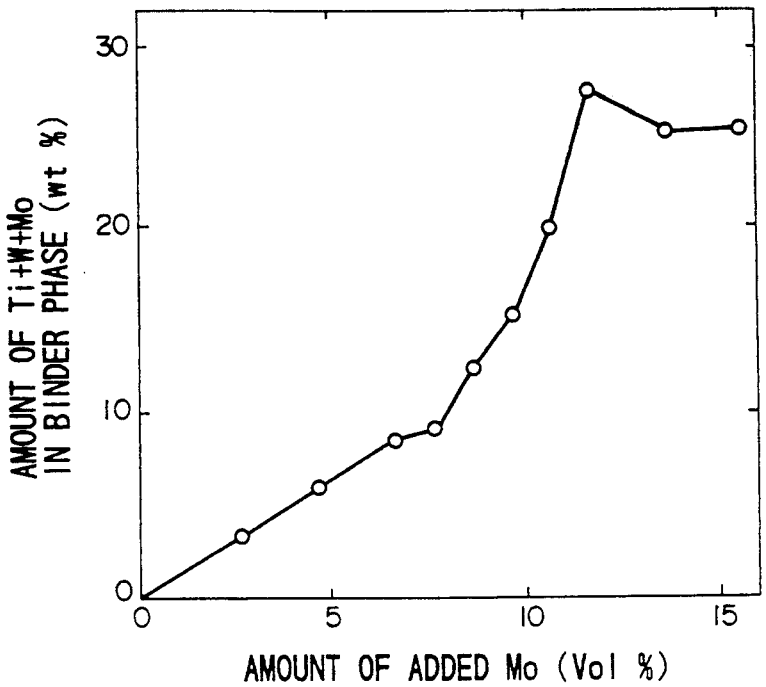
FIG. 3 is a graph illustrating a relationship between the amount of addition of Mo and the amount of "Ti+-Mo+W" dissolved in the binder phase in Example 1.

FIG. 3 illustrates a relationship between the amount of addition of Mo and the amount of "Ti+Mo+W" dissolved in the binder phase shown in Table 2. As the amount of added Mo increases up to 11.7 vol.%, the amount of dissolved "Ti+Mo+W" also increases. However, when Mo is added more than that, the amount of soluted "Ti+Mo+W" no longer increases. The amount of dissolved "Ti+Mo+W" corresponding to the range of amounts of Mo addition in which the hardness of Hv 1600 or more and the cracking resistance of 70 (kg/mm) or more can be obtained is about 7 to 28 wt. %.

Figure 4:
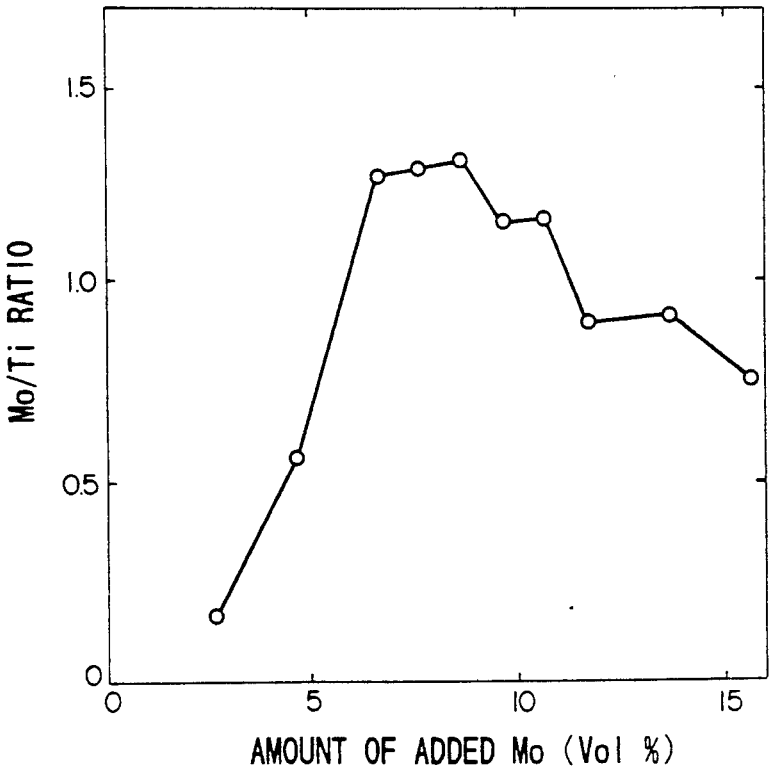
FIG. 4 is a graph illustrating a relationship between the amount of addition of Mo and Mo/Ti in the binder phase in Example 1.

FIG. 4 illustrates a relationship between the amount of addition of Mo and the ratio of Mo (wt. %)/Ti (wt. %). It is obvious from this graph that when the amount of added Mo is 5 vol.% or more, Mo (wt. %)/Ti (wt. %) is about 0.85 or more.

The results shown in FIGS. 1A to 4 are summarized as follows:

1. In order to obtain the hardness of Hv 1600 or more and the cracking resistance of 70 (kg/mm) or more, the amount of addition of Mo should approximately be not less than 5 vol.% and not more than 15 vol.% (see FIGS. 1A and 1B).

2. In this range of addition of Mo, the amount of "Ti+Mo+W" dissolved in the binder phase is in a range of 7 to 28 wt. % (6 wt. % or more in the case of "Ti+Mo") (see FIG. 3).

3. In FIG. 4, the ratio of Mo (wt. %)/Ti (wt. %) is 0.85 or more.

As for a sample No. 10, the amount of dissolved "Ti+Mo+W" exceeds 20 wt. %, and in this respect, it is within the range of the invention. However, its cracking resistance is low. This is probably because the ratio of Mo (wt. %)/Ti (wt. %) is as low as 0.75.

That is to say, concerning the TiC-base cermet alloy, in order to obtain both excellent toughness and hardness by strengthening its binder phase, it is judged that the amount of "Ti+Mo" should be 6 wt. % or more or the amount of "Ti+Mo+W" should be 7 wt. % or more while maintaining the amounts of Mo and Ti dissolved in the binder phase to satisfy the relationship of $0.85 \leqq$ Mo (wt. %)/Ti (wt. %).

Figure 7:
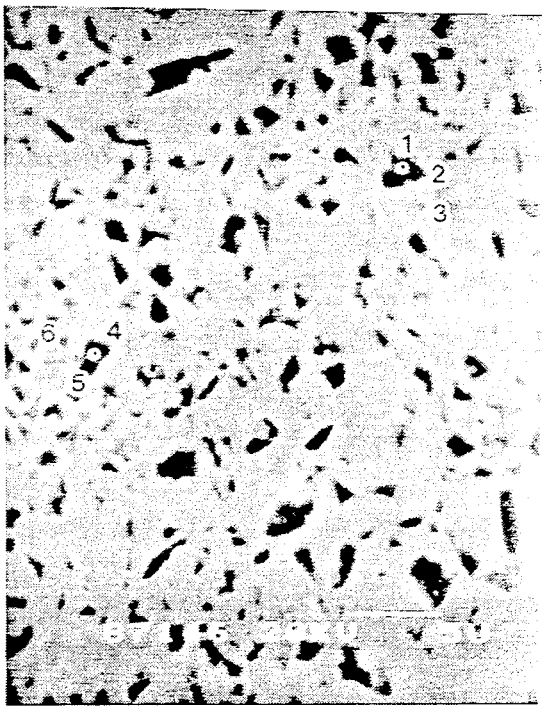
FIG. 7 is a photograph (2400 magnifications) of a micro-structure of an invention alloy.

FIG. 7 shows a photograph (2400×) of a microstructure of a No. 7 alloy in Table 1. In FIG. 7, portions 1 and 4 are TiC, portions 2 and 5 are (Ti, W, Mo)C rich in (Ti, W), and portions 3 and 6 are (Ti, W, Mo)C containing slight amounts of Co and Ni. It is confirmed that the hard phase has the core structure.

Next, a cutting test was conducted with samples having the compositions designated by Sample Nos. 3, 6 and 7 in Table 1. It was conducted under the conditions of cutting speed V=200 m/min, feed rate f=0.3 mm/rev, and cutting depth d=2.0 mm, and JIS SUJ-2 was used as a work material.

Figure 8:
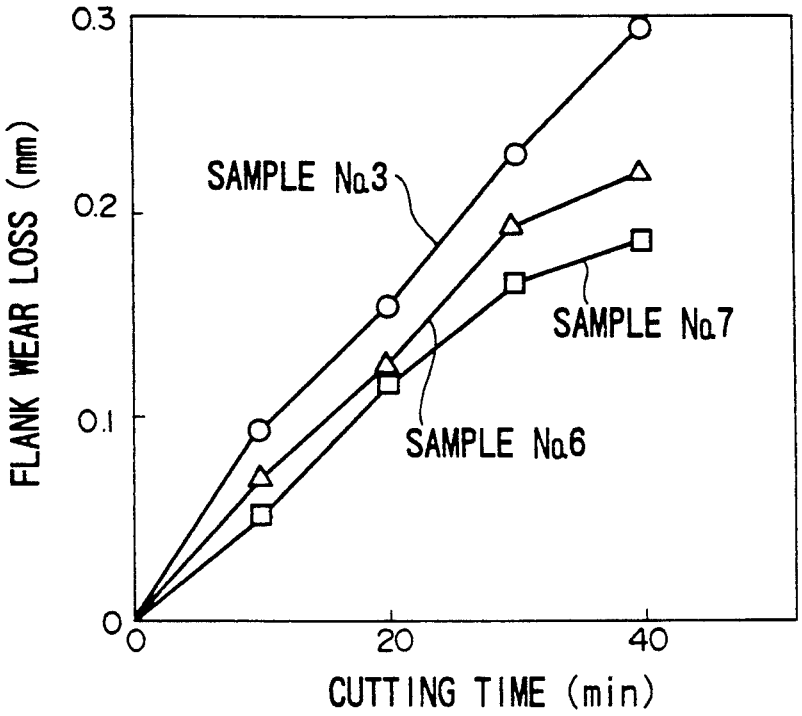
FIG. 8 is a graph of results of a wear resistance test by SUJ2 cutting in Example 1.

Test results are shown in FIG. 8. As the amount of Mo dissolved in the binder phase increases, i.e., in the order of Sample Nos. 7, 6, 3, the wear resistance is improved. This is probably because the binder phase, which contains a large amount of Mo, is increased in the heat resistance although the JIS SUJ-2 is a high-carbon work material which is rather hard so that the cutting edge tends to have high temperature at the time of cutting.

Figure 9:
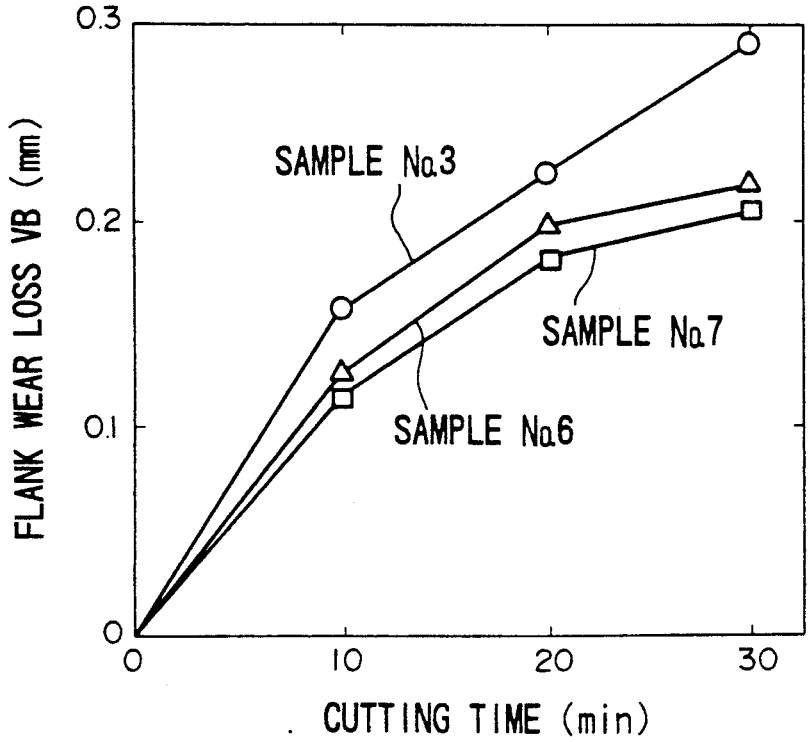
FIG. 9 is a graph of results of a wear resistance test by SCM440 cutting in Example 1.

Another cutting test was conducted under the same conditions as described above except for a work material of JIS SCM440. Test results are shown in FIG. 9. It can be likewise understood that as the amount of Mo dissolved in the binder phase increases, the wear resistance is improved.

Example 2

Samples having different amounts of Co and Ni which constitute the binder phase were used for measuring the hardness and toughness. Compositions of the samples are shown in Table 3. They were manufactured under the same conditions as the example 1.

TABLE 3

| SAMPLE NO. | COMPOSITION (vol. %) TiC | WC | Mo | Co | Ni | Co/[Co+Ni] |
|---|---|---|---|---|---|---|
| 7 | 63.1 | 19.4 | 10.7 | 2.4 | 4.4 | 0.3 |
| 13 | 63.1 | 19.4 | 10.7 | 3.4 | 3.4 | 0.5 |
| 14 | 63.1 | 19.4 | 10.7 | 4.4 | 2.4 | 0.7 |

Figure 10A:
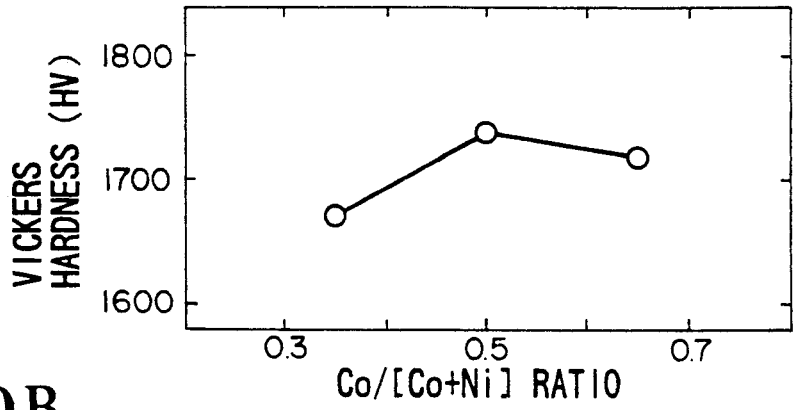
FIG. 10A is a graph of the Vickers hardness in Example 2.
Figure 10B:
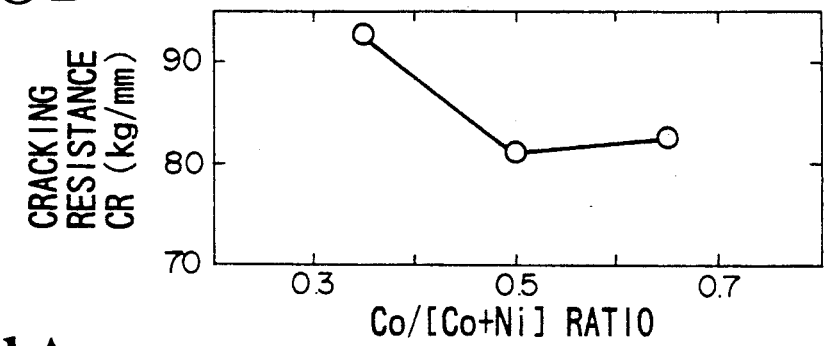
FIG. 10B is a graph of the cracking resistance in Example 2.

FIGS. 10A and 10B illustrate relationships of Co/[Co+Ni] with respect to the hardness (Vickers hardness) and the cracking resistance. As Co/[Co+Ni] becomes larger, the hardness tends to increase, and the cracking resistance tends to decrease on the contrary.

Figure 11A:
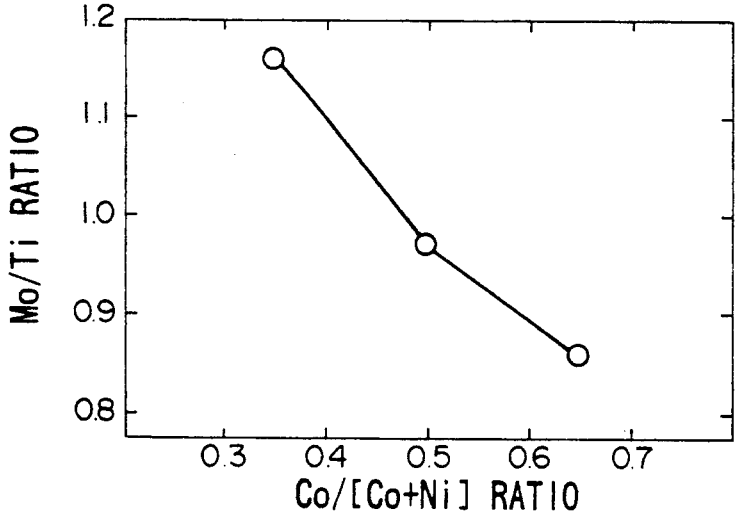
FIG. 11A is a graph of Mo/Ti in Example 2.
Figure 11B:
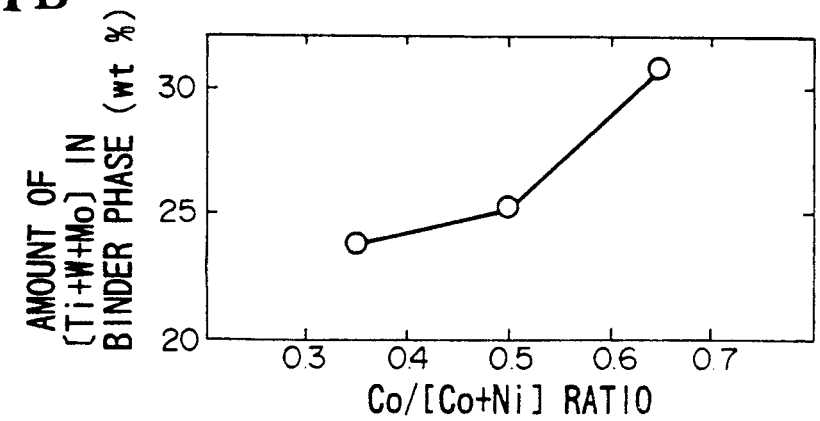
FIG. 11B is a graph of the amount of [Ti+Mo+W] in the binder phase in Example 2.

FIGS. 11A and 11B illustrate relationships between Co/[Co+Ni] and amounts of elements in the binder phase. As for the amounts of "Ti, W, Mo" dissolved in the binder phase, more molybdenum is dissolved than titanium in the case of Co/[Co+Ni]=0.35, and more titanium is dissolved than molybdenum in the case of Co/[Co+Ni]=0.65.

Figure 12A:
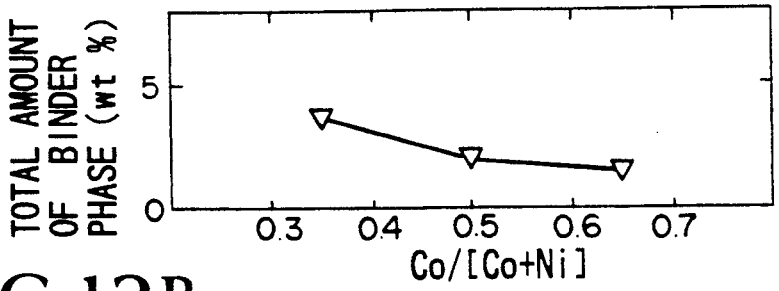
FIG. 12A is a graph of the total amount of the binder phase in Example 2.
Figure 12B:
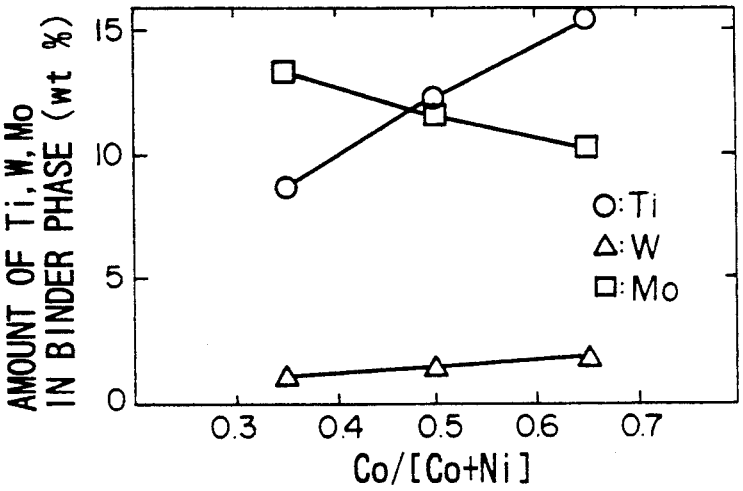
FIG. 12B is a graph of the amounts of Ti, Mo, W in the binder phase in Example 2.

FIG. 12 illustrates relationships of Co/[Co+Ni] with respect to the amount of "Ti+Mo+W" in the binder phase and Mo/Ti. As Co/[Co+Ni] becomes larger, the amount of "Ti+Mo+W" tends to increase, and Mo/Ti tends to decrease on the contrary.

It is understood from the above results that a larger amount of Ni should be added when giving importance to the toughness, and that a larger amount of Co should be added when giving importance to the hardness.

A cutting test of JIS SCM440 was conducted with the above-mentioned samples Nos. 7, 13 and 14. It was conducted under the conditions of cutting speed V=200 m/min, feed rate f=0.3 mm/rev, and cutting depth d=2.0 mm.

Figure 13:
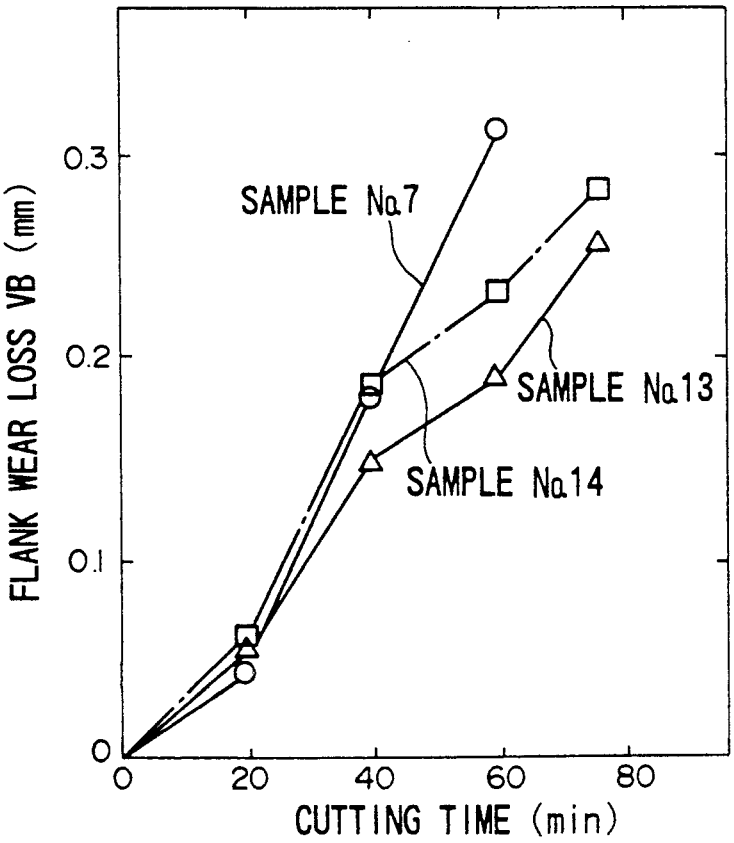
FIG. 13 is a graph of results of a wear resistance test by SCM440 cutting in Example 2.

Test results are shown in FIG. 13. It can be understood that the samples having Co/[Co+Ni] of 0.50 and 0.65 are superior in wear resistance to the sample whose Co/[Co+Ni] is 0.35.

Next, for the purpose of toughness evaluation, a cutting test was conducted with the samples Nos. 7, 11, 13 and 14. It was conducted under the conditions of a work material, of JIS SCM440 (a four-grooved round bar), a cutting speed of 200 m/min, a cutting depth of 2.0 mm, and a chip configuration of SNGN120408R, and breakage resistance was evaluated on the basis of a critical feed rate (mm/rev) and a critical impact number. In this case, the critical feed rate means a speed of feed which causes a breakage, and the critical impact number means the impact number which causes a breakage when the number of collisions against grooves is called the impact number.

Figure 14:
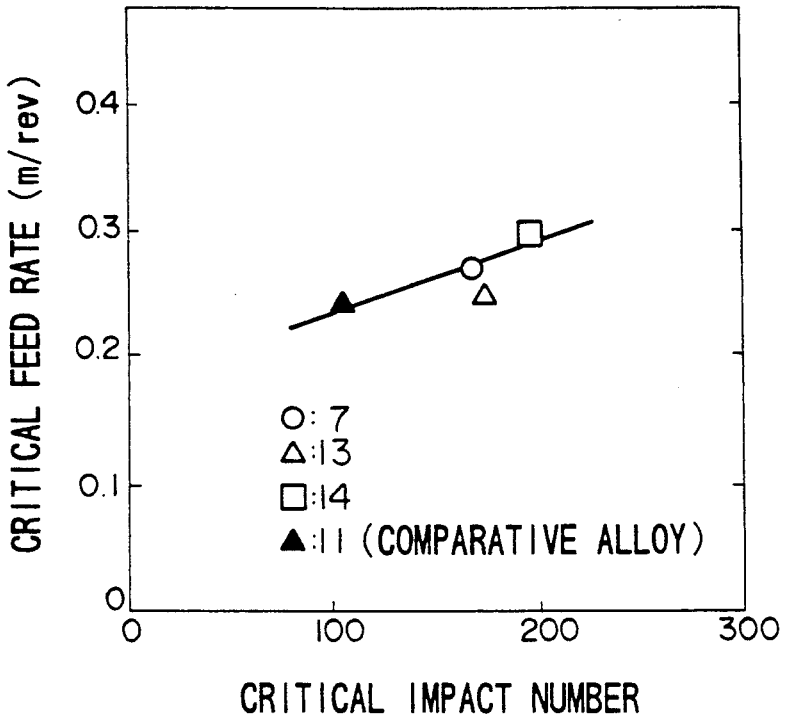
FIG. 14 is a graph of a relationship between the critical impact number and the critical feed rate in Example 2.

Results of the breakage resistance evaluation, amounts of "Ti+Mo+W" dissolved in the binder phase, and the ratio of Mo/Ti in the binder phase are shown in Table 4. It can be understood that the samples Nos. 7, 13 and 14, which are invention alloys are superior in breakage resistance to the sample No. 11 which is a conventional alloy. FIG. 14 illustrates a relationship between the critical impact number and the critical feed rate.

TABLE 4

| SAMPLE NO. | AMOUNT OF DISSOLVED "Ti+Mo+W" IN BINDER PHASE (wt. %) | Mo/Ti | CRITICAL FEED RATE (mm/rev) | CRITICAL IMPACT NUMBER (times) |
|---|---|---|---|---|
| 7 | 19.9 | 0.86 | 0.24 | 170 |
| 13 | 25.6 | 0.95 | 0.25 | 175 |
| 14 | 30.7 | 0.86 | 0.25 | 195 |
| 11 | 5.1 | 0.45 | 0.21 | 103 |

Example 3

Powders of TiC, WC, Mo, Co and Ni corresponding to compositions shown in Table 5 were prepared. The grain sizes of the powders were as follows: in terms of average diameter, TiC: 1.5 μm WC: 1.5 μm Co: 2.0 μm, Ni: 2.5 μm, and Mo: 3.0 μm. These powders were used to obtain samples sintered in substantially the same manner as the example 1.

TABLE 5

| SAMPLE NO. | COMPOSITION (vol. %) TiC | WC | Mo | Co | Ni |
|---|---|---|---|---|---|
| Δ 16 | 63.1 | 28.6 | 4.9 | 1.2 | 2.2 |
| ○ 17 | 63.1 | 24.5 | 9.0 | 1.2 | 2.2 |
| ○ 18 | 63.1 | 23.5 | 10.0 | 1.2 | 2.2 |
| ○ 19 | 63.1 | 21.0 | 12.5 | 1.2 | 2.2 |

Figure 15:
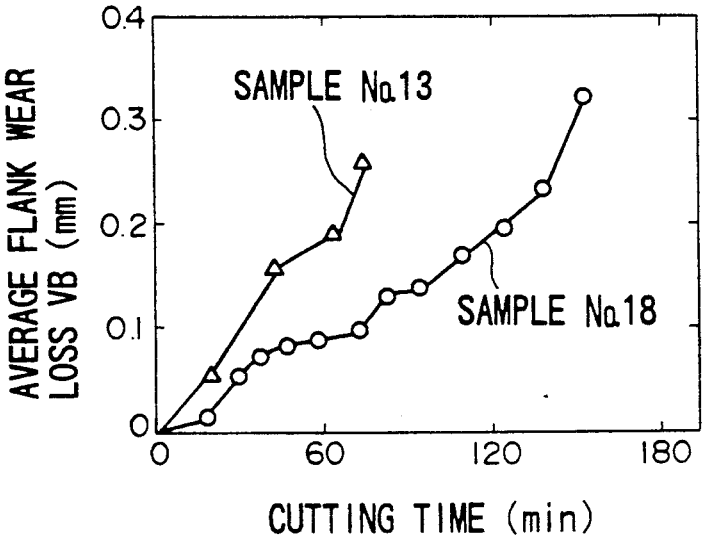
FIG. 15 is a graph of results of a wear resistance test by SCM435 cutting in Example 3.

A cutting test of JIS SCM440 was conducted with a sample No. 18 shown in Table 5. It was conducted under the conditions of cutting speed V=200 m/min, feed rate f=0.3 mm/rev, and cutting depth d=2.0 mm. Test results are shown in FIG. 15. The test results of the sample No. 13 shown in FIG. 13 are also shown for reference in FIG. 15.

The sample No. 18 according to this embodiment is superior in wear resistance to the sample No. 13. This is probably because the amounts of addition of Ni and Co which are component elements of the binder phase are smaller and the amount of the hard phase is accordingly larger in the case of the sample No. 18 than the sample No. 13.

Figure 16:
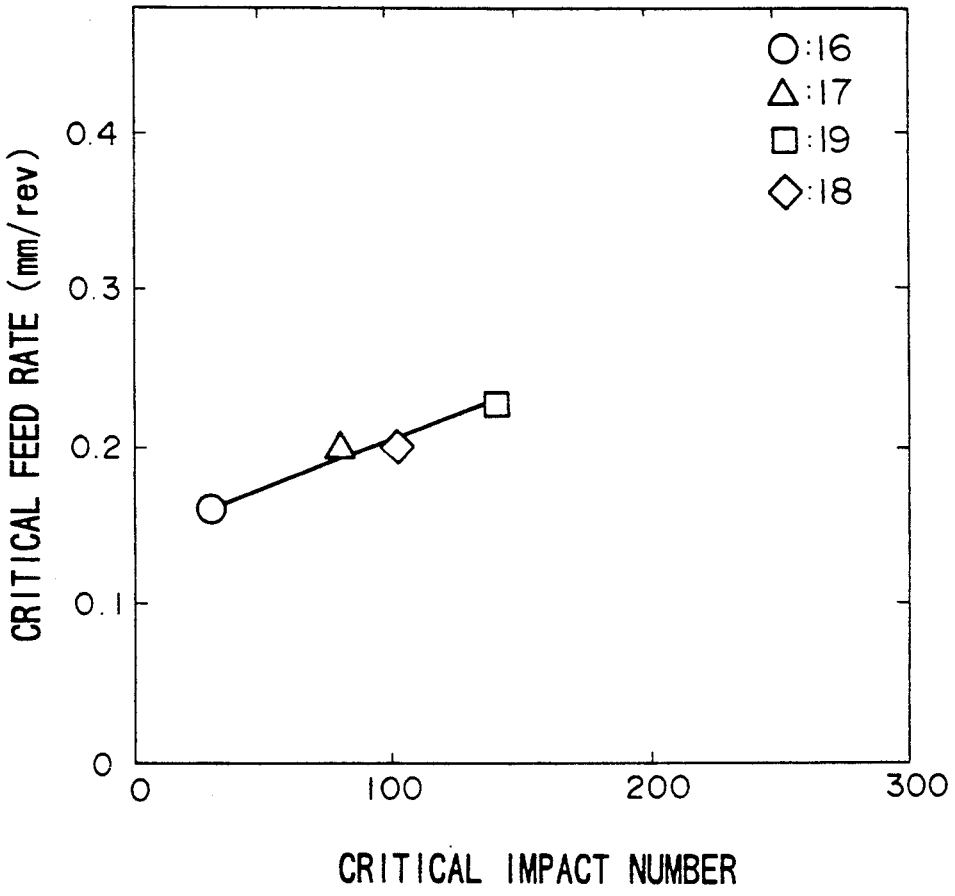
FIG. 16 is a graph of a relationship between the critical impact number and the critical feed ,rate in Example 3.

Next, evaluation of the toughness was conducted with the samples Nos. 16, 17, 18 and 19 shown in Table 5 in substantially the same manner as the Example 2. Results of the evaluation, amounts of "Ti+Mo+W" dissolved in the binder phase, and the ratio of Mo (wt. %)/Ti (wt. %) in the binder phase are shown in Table 6. It can be understood that the samples Nos. 17, 18 and 19 which are invention alloys are superior in breakage resistance to the sample No. 16 which is comparative alloy. FIG. 16 illustrates a relationship between the critical impact number and the critical feed rate.

TABLE 6

| SAMPLE NO. | AMOUNT OF DISSOLVED "Ti+Mo+W" IN BINDER PHASE (wt. %) | Mo/Ti | CRITICAL FEED RATE (mm/rev) | CRITICAL IMPACT NUMBER (times) |
|---|---|---|---|---|
| Δ 16 | 10.4 | 0.41 | 0.16 | 30 |
| ○ 17 | 17.4 | 0.95 | 0.20 | 80 |
| ○ 18 | 22.1 | 0.95 | 0.23 | 140 |
| ○ 19 | 24.6 | 0.90 | 0.20 | 105 |

Example 4

Wet cutting was conducted with the above-mentioned sample No. 13 and samples having compositions (vol. %) designated by Nos. 20 and 21 shown in Table 7. It was conducted under the conditions of a work material of JIS SCM435 (hardness Hs=31), a cutting speed of 200 m/min, a feed rate of 0.3 mm/rev, a cutting depth of 2.0 mm, and a chip configuration of SNGN432R, and water-soluble wax was used as cutting oil.

As for chips which were made of the samples Nos. 20 and 21, heat cracks were generated in cutting edges 30 seconds after the start of cutting.

Figure 17:
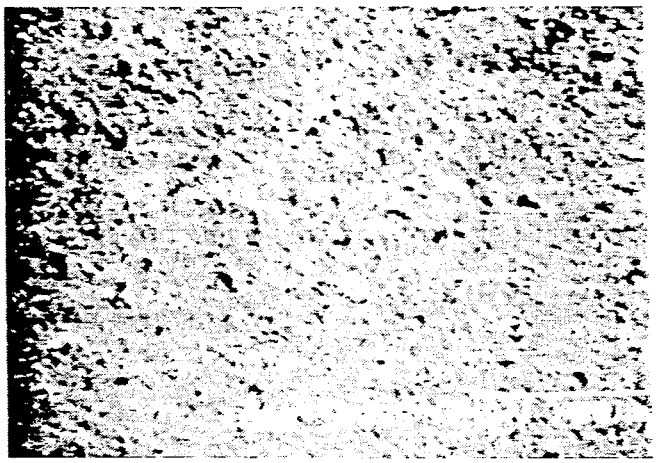
FIG. 17 is a photograph (600 magnifications) of a micro-structure of an edge portion of a chip which is made of an invention alloy used in Example 4.
Figure 18:
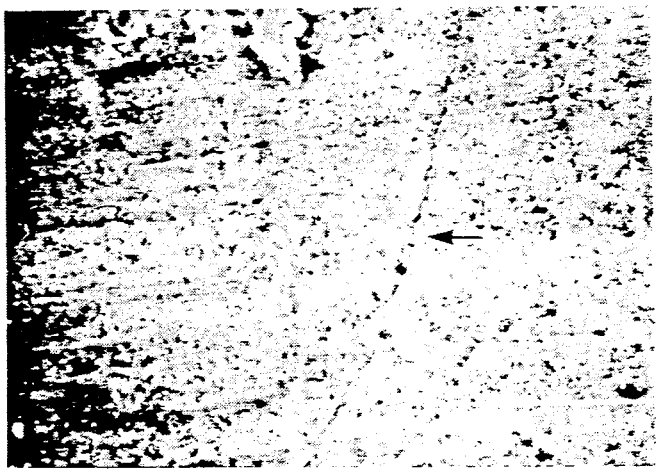
FIG. 18 is a photograph (600 magnifications) of a micro-structure of an edge portion of a chip which is made of a conventional alloy used in Example 4.
Figure 19:
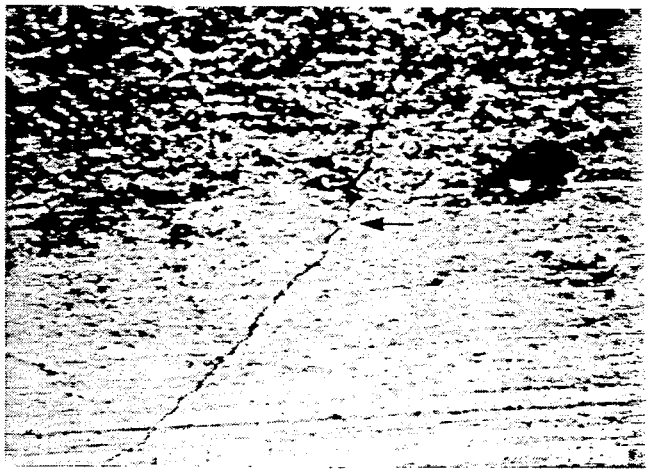
FIG. 19 is a photograph (600 magnifications) of a micro-structure of an edge portion of a chip which is made of a conventional alloy used in Example 4.

FIGS. 17, 18 and 19 respectively show enlarged micro-photographs (600×) of flanks of chips which were made of the samples Nos. 13, 20 and 21 when the flank wear loss reached 0.3 mm. It can be understood that long heat cracks were generated in the samples 20 and 21, as indicated by arrows in the photographs, whereas no heat cracks were generated in the sample No. 13. The length of a heat crack was 0.35 mm in the case of the sample No. 20 shown in FIG. 18, and 0.30 mm in the case of the sample No. 21 shown in FIG. 19.

Table 7 shows amounts of "Ti+Mo+W" dissolved in the binder phase of the sintered samples. When the amounts of dissolved "Ti+Mo+W" and generations of heat cracks are compared, it is obvious that these two correspond to each other. In other words, no heat cracks are generated in the sample No. 13 in which the amount of dissolved "Ti+Mo+W" is the highest, and as for the samples Nos. 20 and 21 in which heat cracks are generated, the length of a heat crack is short in the case of the sample No. 21 in which the amount of dissolved "Ti+Mo+W" is the higher.

Heat and impact resistance is required for a material of a machine tool for wet cutting. It can be understood from the above results that it is effective to increase the amount of dissolved "Ti+Mo+W" in the invention, to thereby improve the heat and impact resistance and prevent generation of heat cracks.

TABLE 7

| SAMPLE NO. | TiCN | WC | $Mo_2C$ | Co | Ni | OTHERS | DISSOLVED "Ti+Mo+W" (wt. %) |
|---|---|---|---|---|---|---|---|
| 13 | — | — | — | — | — | — | 26.6 |
| 20 | 84 | 4.2 | 3 | 3.7 | 2.6 | VC: 2.2, ZrC: 0.3 | 6.9 |
| 21 | 73.85 | 5.6 | 4.4 | 5.0 | 5.0 | NbC: 3.7 | |

As will be apparent from the above, according to the present invention, there can be obtained the TiC-base cermet alloy which has the same level of hardness as the TiCN-base cermet alloy and which is remarkably improved in toughness, and besides, this TiC-base cermet alloy does not involve the problem of generation of pores as a result of denitrification at the time of vacuum sintering.

What is claimed is:

1. A cermet alloy comprised of a hard phase and a binder phase, said hard phase consisting essentially of titanium carbide, said binder phase consisting essentially of one or both of Co and Ni, wherein said binder phase further includes elemental Mo and Ti where the ratio (Mo/Ti), in weight %, ≧0.85 and where the total elemental Ti and Mo content, in weight %, ≧6.

2. A cermet alloy comprised of a hard phase and a binder phase, said hard phase consisting essentially of metal carbides, said metal in said carbides being selected from the group consisting of Ti and W, said binder phase consisting essentially of one or both of Co and Ni, wherein said binder phase further includes elemental Mo, Ti and W where the ration (Mo/Ti), in weight %, ≧0.85 and where the total elemental Ti, Mo and W content, in weight %, ≧7.

* * * * *

UNITED STATES PATENT AND TRADEMARK OFFICE

CERTIFICATE OF CORRECTION

PATENT NO. : 5,248,352

DATED : September 28, 1993

INVENTOR(S) : Yuichi NAKAHARA et al.

It is certified that error appears in the above-indentified patent and that said Letters Patent is hereby corrected as shown below:

In claim 2, column 12, line 50, change "ration" to --ratio--.

Signed and Sealed this

Twenty-second Day of February, 1994

*Attest:*

BRUCE LEHMAN

*Attesting Officer*

*Commissioner of Patents and Trademarks*